US010900212B1

(12) United States Patent
Ben Shoshan

(10) Patent No.: US 10,900,212 B1
(45) Date of Patent: Jan. 26, 2021

(54) MAGNETIC FLAPPER FLUSH VALVE

(71) Applicant: Rami Ben Shoshan, West Hollywood, CA (US)

(72) Inventor: Rami Ben Shoshan, West Hollywood, CA (US)

( * ) Notice: Subject to any disclaimer, the term of this patent is extended or adjusted under 35 U.S.C. 154(b) by 0 days.

(21) Appl. No.: 16/938,572

(22) Filed: Jul. 24, 2020

(51) Int. Cl.
*E03D 1/34* (2006.01)
*E03D 1/30* (2006.01)

(52) U.S. Cl.
CPC ..... *E03D 1/34* (2013.01); *E03D 1/306* (2013.01)

(58) Field of Classification Search
CPC ..... E03D 1/34; E03D 1/306
USPC ..... 4/392
See application file for complete search history.

(56) References Cited

U.S. PATENT DOCUMENTS 2,907,050 A * 10/1959 Harris ..... E03D 1/34 4/403
4,365,365 A * 12/1982 Antunez ..... E03D 1/34 4/378
2004/0172746 A1* 9/2004 Nichols-Roy ..... E03D 1/306 4/379
2007/0245475 A1* 10/2007 Goldman ..... E03D 1/34 4/378

* cited by examiner

*Primary Examiner* — Huyen D Le
(74) *Attorney, Agent, or Firm* — Plager Schack LLP; Mark H. Plager; Kara Verryt

(57) ABSTRACT

A magnetic flapper flush valve system for toilets may include a flush tube; a flapper arm pivotally engaged with the flush tube, the flapper arm including a balanced counterweight at a first end thereof; a weighted dome attached to a second end of the flapper arm, wherein the weighted dome includes a flapper dome frame and a top magnetic ring attached to a bottom surface of the flapper dome frame; a flush valve base attached to a bottom end of the flush tube, the flush valve base being a tube with a circular upper opening, the upper opening sized and shaped to accommodate placement of weighted dome therein; and a bottom magnetic ring attached to the flush valve base, wherein the bottom magnetic ring is positioned to removably engage with the top magnetic ring when the weighted dome is positioned within the flush valve base.

10 Claims, 4 Drawing Sheets

MAGNETIC FLAPPER FLUSH VALVE

BACKGROUND

The embodiments described herein relate generally to toilet plumbing and, more particularly, to a magnetic flapper flush valve system for toilets.

Toilets include a flush valve system that controls flow of water from the tank to the bowl. Flappers in flush valve systems often leak, because many existing systems use ordinary rubber seals, which fail over time and need to be replaced regularly.

Therefore, what is needed is a magnetic flapper flush valve system for toilets that creates a tight, complete seal to prevent water from leaking while also outlasting the existing flush systems.

SUMMARY

Some embodiments of the present disclosure include a magnetic flapper flush valve system for toilets. The system may include a flush tube; a flapper arm pivotally engaged with the flush tube, the flapper arm including a balanced counterweight at a first end thereof; a weighted dome attached to a second end of the flapper arm, wherein the weighted dome includes a flapper dome frame and a top magnetic ring attached to a bottom surface of the flapper dome frame; a flush valve base attached to a bottom end of the flush tube, the flush valve base being a tube with a circular upper opening, the upper opening sized and shaped to accommodate placement of weighted dome therein; and a bottom magnetic ring attached to the flush valve base, wherein the bottom magnetic ring is positioned to removably engage with the top magnetic ring when the weighted dome is positioned within the flush valve base. Some embodiments may also include at least one detergent ball positioned in the flush tube, the detergent ball aiding in sanitizing and deodorizing the toilet.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

Figure 1:
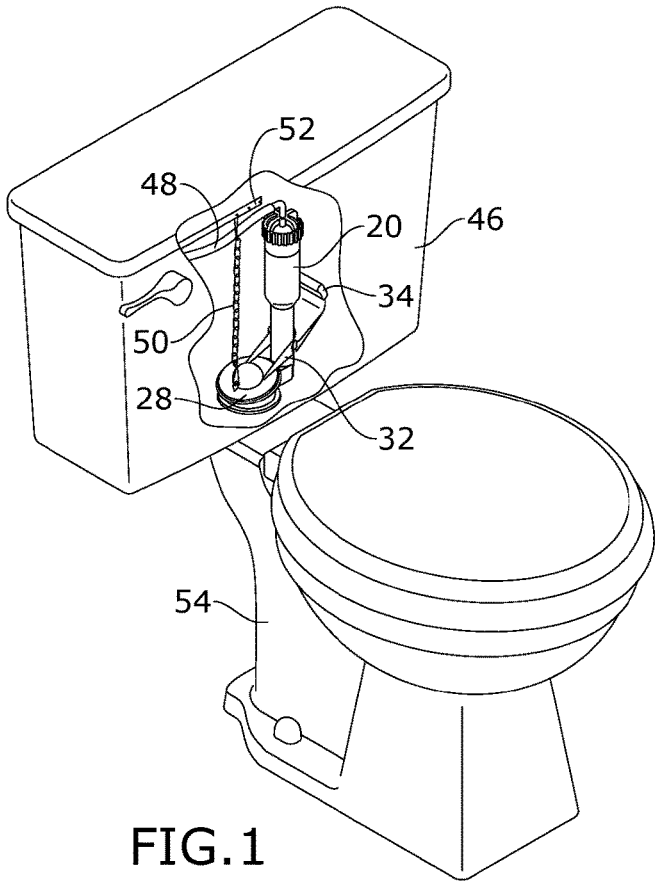
FIG. 1 is a perspective view of one embodiment of the present disclosure, shown in use.
Figure 2:
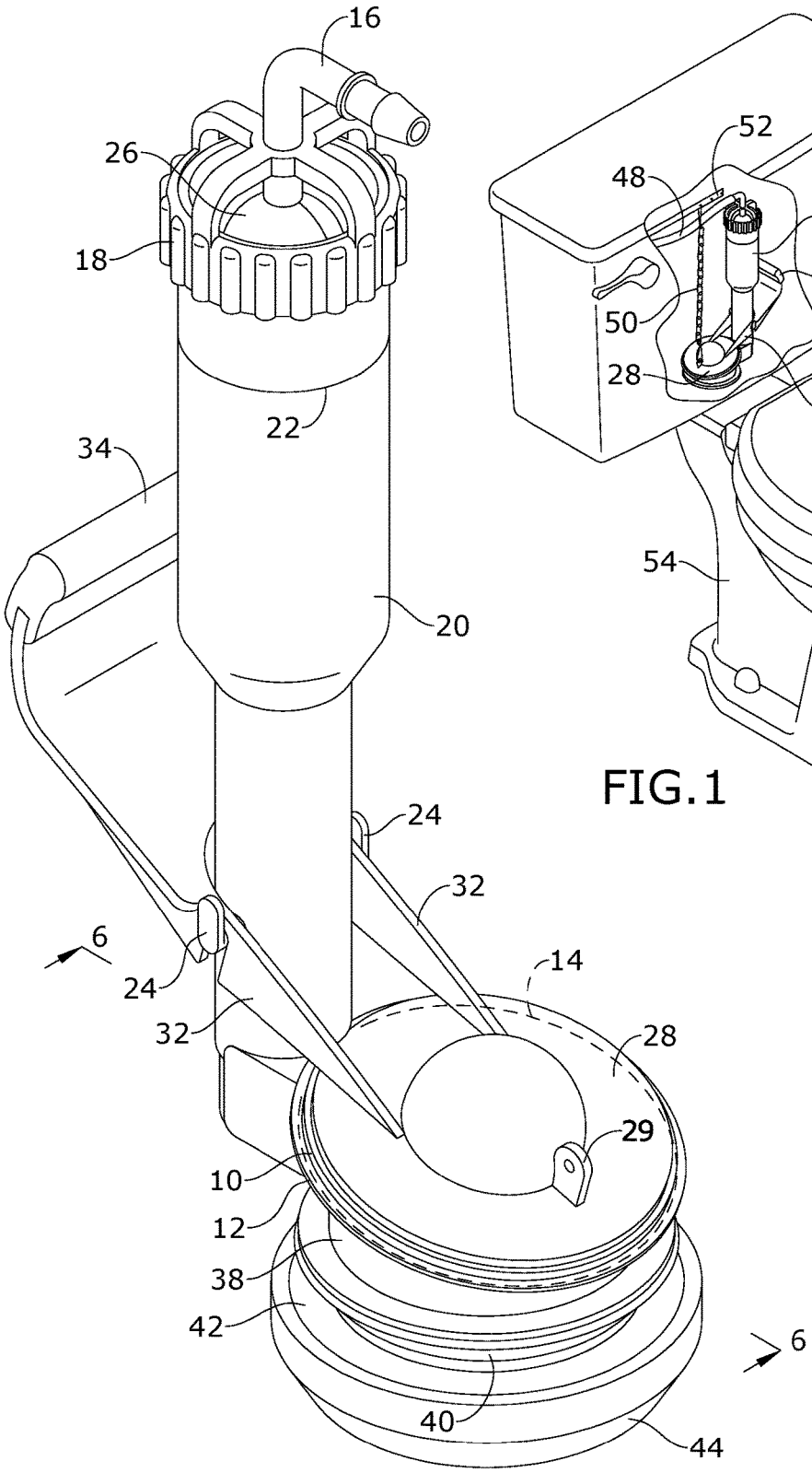
FIG. 2 is a perspective view of one embodiment of the present disclosure.
Figure 3:
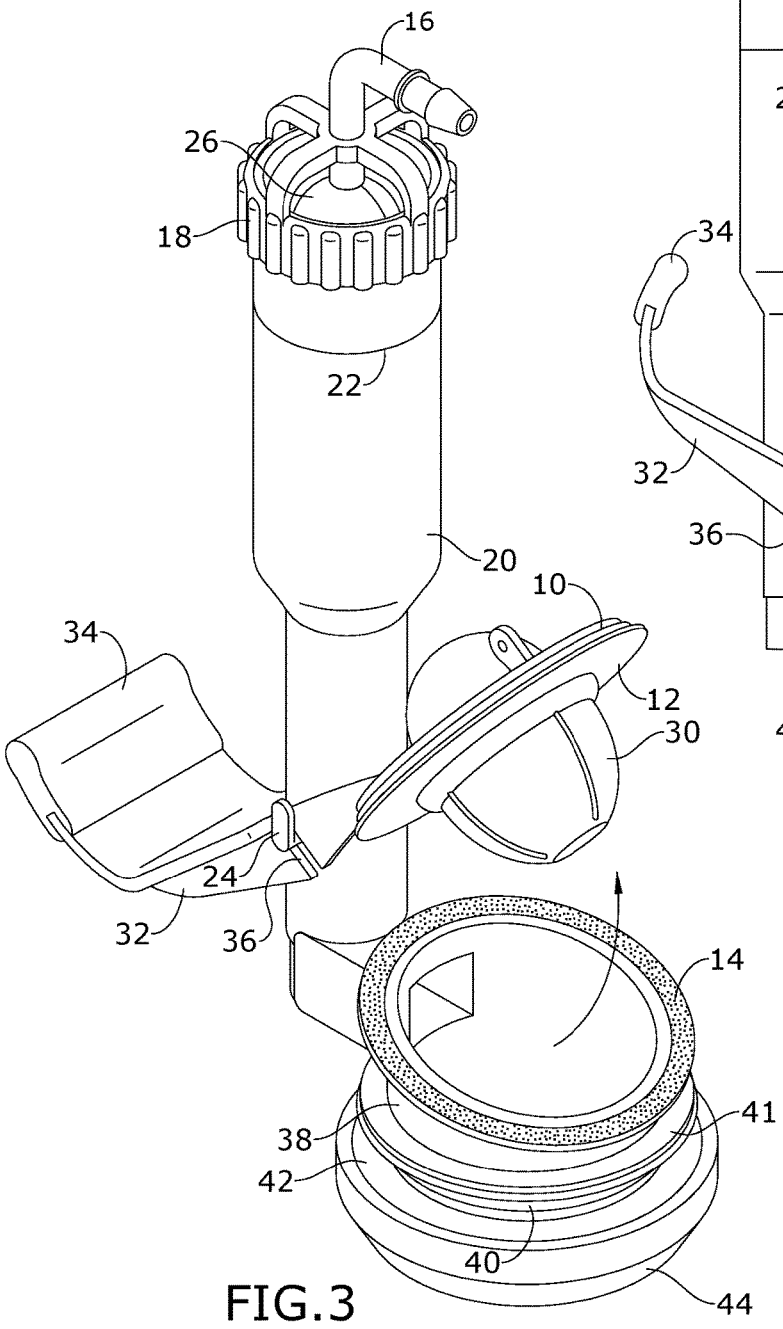
FIG. 3 is a perspective view of one embodiment of the present disclosure.
Figure 4:
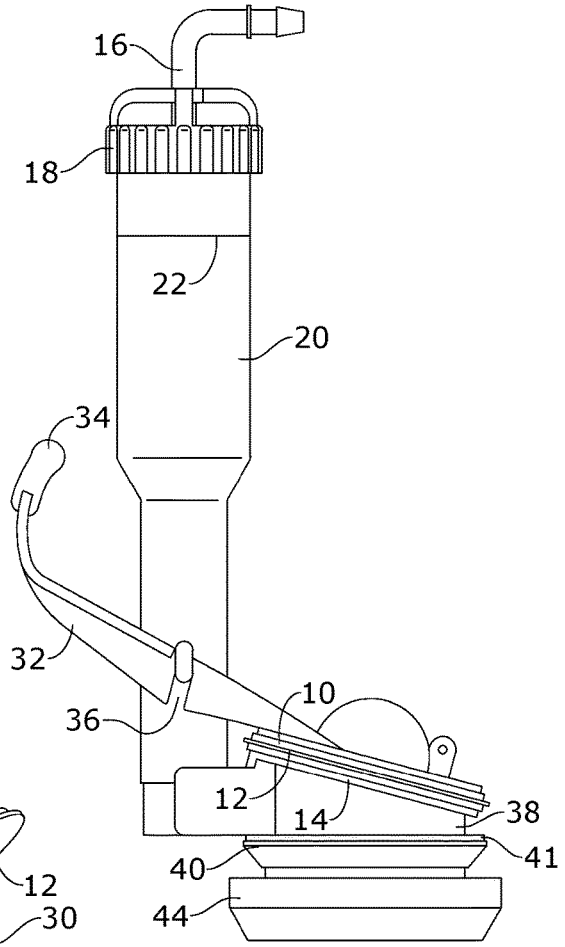
FIG. 4 is a side view of one embodiment of the present disclosure.
Figure 5:
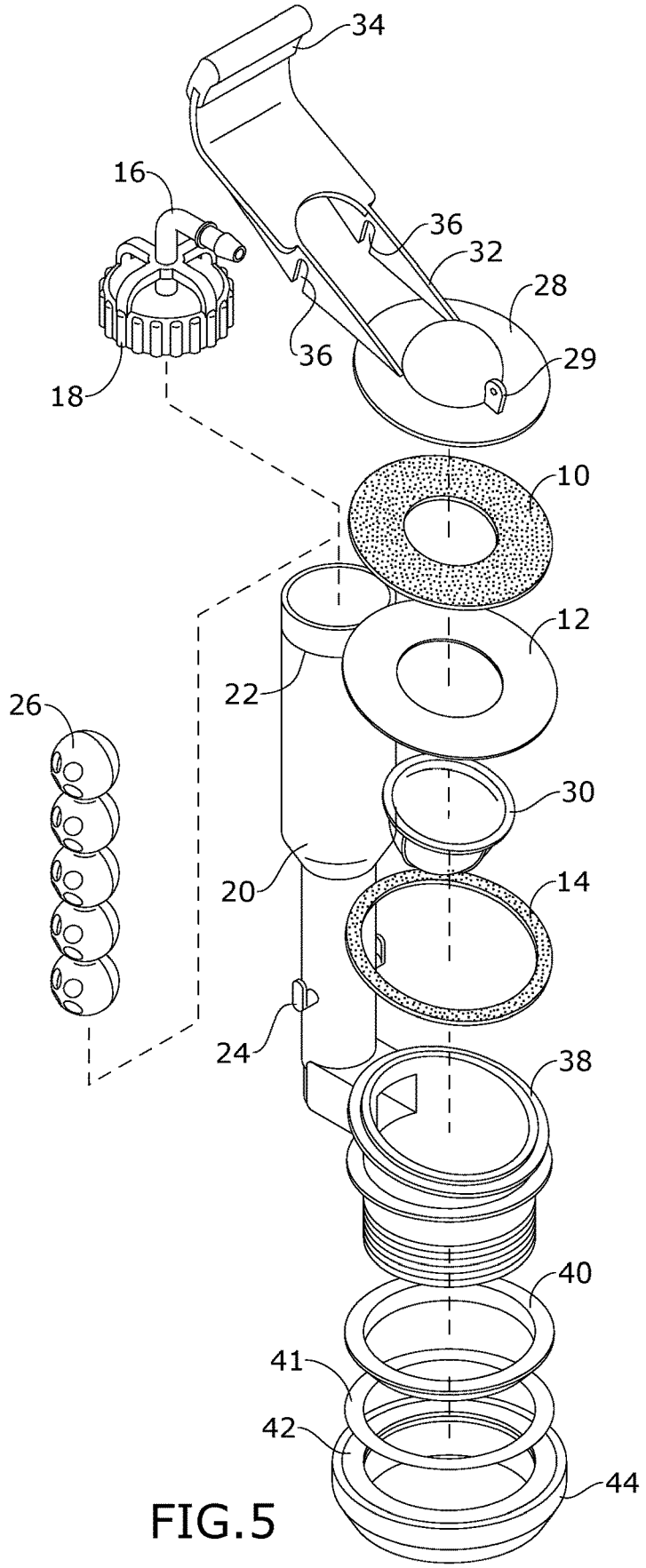
FIG. 5 is an exploded view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a flapper flush valve system for a toilet and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements and the following examples are presented as illustrative examples only.

By way of example, and referring to FIGS. 1-6, some embodiments of the invention include a magnetic flapper flush valve system for toilets, the system comprising a magnetic rubber seal that prevents leaks into the toilet bowl. Specifically, the system comprises at least one flapper arm 32 pivotally engaged with an flush tube 20, the flapper arm 32 including a balanced counterweight 34 at a first end thereof, and a weighted dome at a second end of the flapper arm 32, wherein the weighted dome comprises a flapper dome frame 28 attached to the flapper arm 32, a top magnetic ring 10 attached to a bottom surface of the flapper dome frame 28, a rubber seal 12 positioned adjacent to a bottom surface of the top magnetic ring 10, and a removable flapper dome 30 positioned adjacent to a bottom surface of the rubber seal 12. As shown in the Figures, the counterweight 34 and flapper arm 32 together may form a substantially rounded L-shape.

In embodiments and as shown in the Figures, the flapper dome frame 28 comprises a substantially semi-circular dome extending from an upper surface thereof (i.e., away from the top magnetic ring) and a planar lip extending outward from a bottom edge of the semi-circular dome. Each of the top magnetic ring 10 and the rubber seal 12 may be substantially ring-shaped with a center orifice extending there through. The removable flapper dome 30 may comprise a substantially semi-circular dome extending away from a bottom surface of the rubber sealer 12, wherein the flapper dome frame 28 and the removable flapper dome 30 together form a substantially spherically shaped weighted dome.

Embodiments of the system further comprise an elongated flush tube 20, wherein an upper portion thereof has a larger diameter than a lower portion thereof and a flush valve base 38 attached to a bottom end of the flush tube 20. The top of the flush tube 20 may include a cap 18 removably attached thereto, wherein a water inlet stem 16 may extend from a top surface thereof, the water inlet stem 16 designed to engage with a water inlet line 48, as shown in FIG. 1. A top portion of the flush tube 20 may include a plurality of detergent balls 26, such as 5 detergent balls, positioned therein. As shown, the detergent balls 26 may be substantially spherical and may help keep the toilet bowl sanitized and deodorized. At least one pivot post 24 may extend from an outer surface of the lower portion of the flush tube 20, wherein the at least one pivot post 24 may be designed to engage with a pivot slot on the at least one flapper arm 32. As shown in the Figures, the system may comprise two flapper arms 32, wherein the flapper arms 32 are spaced apart such that the bottom portion of the flush tube 20 fits there between, wherein the flapper arms 32 comprise pivot slots 36 designed to engage with a pivot post 24 on opposite sides of the bottom portion of the flush tube 20.

Figure 6:
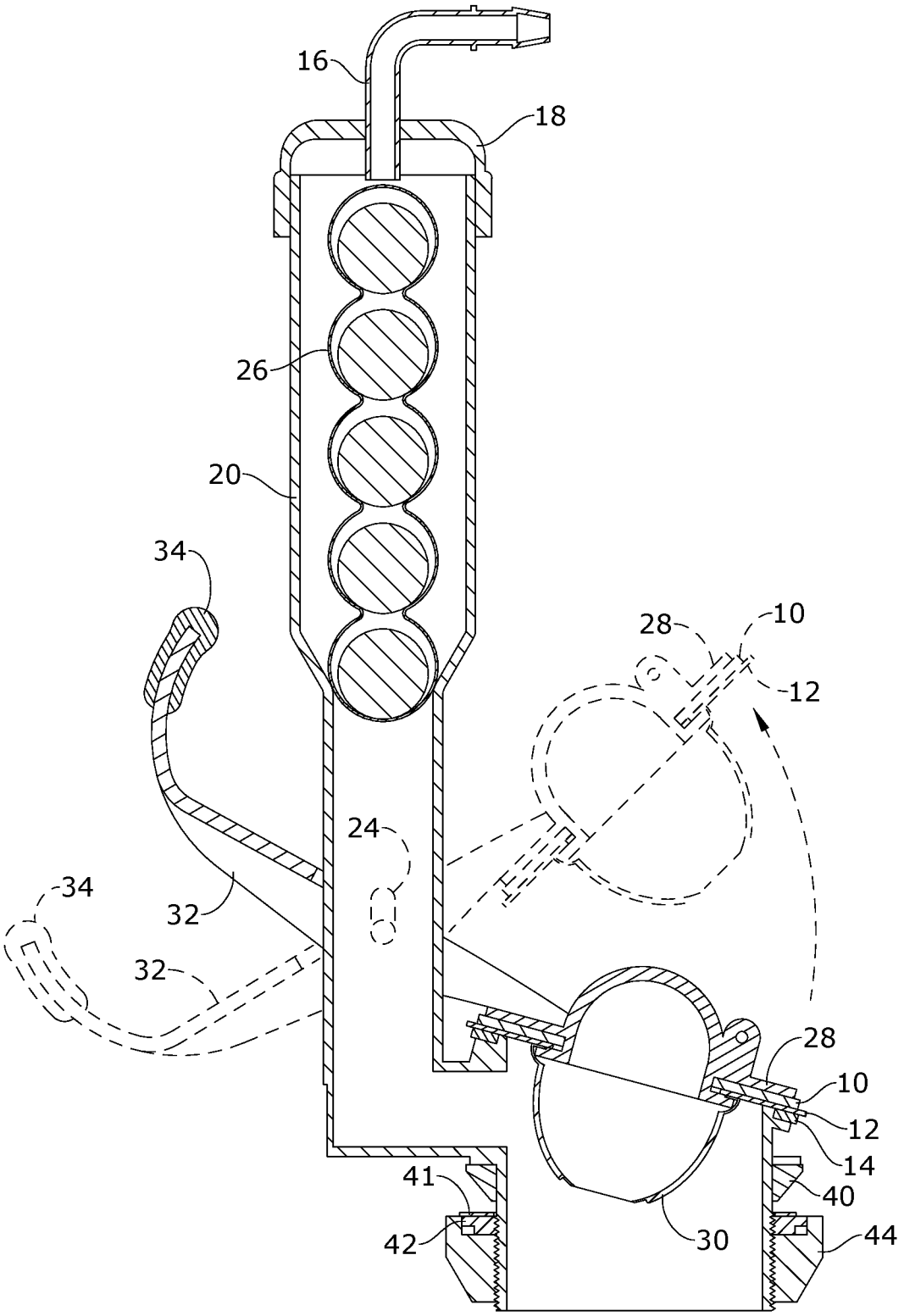
FIG. 6 is a section view of one embodiment of the present disclosure, taken along line 6-6 in FIG. 2.

In embodiments, the flush valve base 38 may comprise a tube with a circular upper opening, the upper opening sized and shaped to accommodate placement of the removable flapper dome 30 therein, as shown in FIG. 6. A top surface of the flush valve base 38 may comprise a rim extension, wherein a bottom magnetic ring 14 is positioned thereon such that when the weighted dome is positioned against the flush valve base 38, the top magnetic ring 10 and the bottom magnetic ring 14 removably engage with one another, keeping the weighted dome in place and preventing water from leaking through the flush valve base 38 and into the toilet body 54. As further shown in the Figures, the flush valve base 38 includes a cylindrical bottom portion that extends into a tank gasket 44 such that water flows through the flush valve base 38 and the tank gasket 44 into the toilet body 54. The system may further comprise, in order, a flush valve gasket 40, a washer 41, and a flush valve lock nut 42 positioned between the flush valve base 38 and the tank gasket 44.

In embodiments, the flapper dome frame 28 may be operatively attached to the flush handle 52 on the toilet tank 46. For example, a flapper chain 50 may attach the flush handle 52 to a chain holder 29 extending from the flapper dome frame 28. In embodiments, the chain holder 29 may extend from a side surface of the semi-circular dome on the flapper dome frame 28, such that when the flush handle 52 is used by a user, the flapper chain 50 pulls upward on the flapper dome frame 28, causing the top magnetic ring 10 and the bottom magnetic ring 12 to disengage, causing the weighted dome to rise and allowing water to flow through the flush valve base 38 and ultimately into the toilet bowl. After flushing, the weighted dome may fall back into place on the flush valve base 38. As a result, the magnetic rings 10, 14 to may engage, creating a magnetic seal to prevent water from inadvertently flowing from the tank 46 into the toilet bowl. While water fills the tank after flushing, water may also flow from the water line 48, through the water inlet stem 16, through the flush tube 20 and past the detergent balls 26, when included, to the toilet bowl.

The components of the system of the present disclosure may have any suitable or desired dimensions and may comprise any suitable materials. In a particular embodiment, the flush tube 20 may include a score line 22, which may provide a guide for cutting the flush tube 20 to accommodate the height of the existing flush handle in relation to the water level in the tank, preventing overfill. While the dimensions may vary depending on the toilet to which the system is being attached, in some embodiments the components may have the following dimensions. The top magnetic ring 10 may have an inner diameter of about 3.2 cm and an outer diameter of about 6.9 cm. The rubber seal 12 may have an inner diameter of about 3.6 cm, an outer diameter of about 7.3 cm, an inside thickness of about 2 mm, and an outside thickness of about 1 mm. The bottom magnetic ring 14 may have an inner diameter of about 6 cm, and outer diameter of about 7 cm, and a thickness of about 2 mm.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A magnetic flapper flush valve system for toilets, the system comprising:

a flush tube;

at least one flapper arm pivotally engaged with the flush tube, the flapper arm comprising a balanced counterweight at a first end thereof;

a weighted dome attached to a second end of the at least one flapper arm, the weighted dome comprising a flapper dome frame and a top magnetic ring attached to a bottom surface of the flapper dome frame;

a flush valve base attached to a bottom end of the flush tube, the flush valve base comprising a tube with a circular upper opening, the upper opening sized and shaped to accommodate placement of weighted dome therein; and a bottom magnetic ring attached to the flush valve base, wherein the bottom magnetic ring is positioned to removably engage with the top magnetic ring when the weighted dome is positioned within the flush valve base.

2. The magnetic flapper flush valve system of claim 1, wherein a top surface of the flush valve base comprises a rim extension and the bottom magnetic ring is positioned thereon.

3. The magnetic flapper flush valve system of claim 1, wherein the weighted dome further comprises:

a rubber seal positioned adjacent to a bottom surface of the top magnetic ring; and a removable flapper dome positioned adjacent to a bottom surface of the rubber seal, wherein the flapper dome frame and the removable flapper dome together form a substantially spherical weighted dome.

4. The magnetic flapper flush valve system of claim 1, wherein:

an upper portion of the flush tube has a larger diameter than a lower portion of the flush tube; and the upper portion of the flush tube has at least one detergent ball positioned therein.

5. The magnetic flapper flush valve system of claim 4, further comprising a cap removably attached to the upper portion of the flush tube; and a water inlet stem extending from a top surface of the cap, the water inlet stem sized to engage with a water inlet line.

6. The magnetic flapper flush system of claim 1, further comprising at least one pivot post extending from an outer surface of the flush tube, wherein the at least one pivot post is designed to engage with a pivot slot on the at least one flapper arm.

7. The magnetic flapper flush system of claim 1, wherein the at least one flapper arm and the balanced counterweight together form a rounded L-shape.

8. The magnetic flapper flush system of claim 1, wherein:

the flush valve base includes a cylindrical bottom portion that extends into a tank gasket; and the system further comprises, in order, a flush valve gasket, a washer, and a flush valve lock nut positioned between the flush valve base and the tank gasket.

9. The magnetic flapper flush system of claim 1, wherein the flapper dome frame is operatively attached to a flush handle on the toilet.

10. The magnetic flapper flush system of claim 9, further comprising:

a flapper chain attaching the flush handle to an chain holder extending from the flapper dome frame.

* * * * *